US007967429B2

(12) United States Patent
Kawamura

(10) Patent No.: US 7,967,429 B2
(45) Date of Patent: Jun. 28, 2011

(54) INK TANK AND INK JET CARTRIDGE

(75) Inventor: Shogo Kawamura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 339 days.

(21) Appl. No.: 12/362,290

(22) Filed: Jan. 29, 2009

(65) Prior Publication Data

US 2009/0207217 A1 Aug. 20, 2009

(30) Foreign Application Priority Data

Feb. 15, 2008 (JP) ..... 2008-034660

(51) Int. Cl.
*B41J 2/175* (2006.01)

(52) U.S. Cl. ..... 347/86; 347/84; 347/85; 347/87; 347/88; 347/89; 347/90; 347/91; 347/92; 347/93; 347/94

(58) Field of Classification Search ..... 347/1–109
See application file for complete search history.

(56) References Cited

U.S. PATENT DOCUMENTS

| | | | | |
|---|---|---|---|---|
| 5,847,735 | A * | 12/1998 | Betschon | 347/86 |
| 6,024,442 | A | 2/2000 | Sato et al. | 347/85 |
| 6,338,552 | B1 | 1/2002 | Sato et al. | 347/85 |
| 6,637,865 | B1 | 10/2003 | Murakami et al. | 347/56 |
| 7,290,861 | B2 * | 11/2007 | Inoue et al. | 347/49 |
| 7,311,388 | B2 | 12/2007 | Ogura et al. | 347/87 |
| 7,344,233 | B2 * | 3/2008 | Studer et al. | 347/86 |
| 7,445,666 | B2 * | 11/2008 | Yanagimachi et al. | 106/31.47 |
| 7,815,298 | B2 * | 10/2010 | Miyazawa et al. | 347/86 |
| 2002/0109760 | A1 * | 8/2002 | Miyazawa et al. | 347/86 |
| 2003/0071874 | A1 * | 4/2003 | Ishizawa et al. | 347/50 |
| 2003/0202063 | A1 * | 10/2003 | Studer et al. | 347/86 |
| 2006/0176348 | A1 * | 8/2006 | Nishioka et al. | 347/86 |
| 2006/0238558 | A1 * | 10/2006 | Hatasa et al. | 347/20 |
| 2007/0195140 | A1 * | 8/2007 | Ishizawa et al. | 347/86 |
| 2007/0229629 | A1 * | 10/2007 | Miyazawa et al. | 347/86 |
| 2007/0263052 | A1 | 11/2007 | Iijima et al. | 347/92 |
| 2008/0055376 | A1 | 3/2008 | Inoue et al. | 347/86 |

FOREIGN PATENT DOCUMENTS

| | | |
|---|---|---|
| JP | 5-318759 | 12/1993 |
| JP | 10-278290 | 10/1998 |

* cited by examiner

*Primary Examiner* — Ryan Lepisto
*Assistant Examiner* — Guy G Anderson
(74) *Attorney, Agent, or Firm* — Fitzpatrick, Cella, Harper & Scinto

(57) ABSTRACT

An ink tank includes a first channel extending in the form of a groove on an external part of the tank in connection with an atmospheric communicating port. The tank also includes a second channel which branches off from the first channel and joins this again and which has a capillary force greater than that of the first channel. Even when some amount of ink has flowed out of the atmospheric communicating port, the capillary force generated in the second channel acts to hold the ink in the channel. Additionally, even when ink is stored in the second channel, the first channel is not closed, and the pressure in the tank is therefore kept in equilibrium with the atmospheric pressure. Therefore, there is little possibility that the ink in the second channel will be pushed out even when the ambient temperature changes.

6 Claims, 10 Drawing Sheets

INK TANK AND INK JET CARTRIDGE

BACKGROUND OF THE INVENTION

1. Field of the Invention

The present invention relates to an ink tank used in a printing apparatus performing a printing operation by ejecting a printing liquid such as ink. In particular, the invention relates to a configuration of an ink tank which prevents problems such as leakage of ink while stably supplying ink to a printing head even when the tank has a change in the internal pressure thereof or when the tank is vibrated during transportation.

2. Description of the Related Art

Ink jet printing apparatus are what are called non-impact type printing apparatus. They are characterized by capability of high-speed printing and capability of performing printing on various printing medium and characterized in that they make substantially no noise during printing. Therefore, ink jet printing apparatus are widely used as primary apparatus to serve as printing mechanisms of printers, word processors, facsimile machines, and copiers.

Such an ink jet printing apparatus has a printing head for ejecting ink on to a printing medium and an ink tank for intermittently supplying ink to the printing head. While the printing head and the ink tank are integrally formed in some configurations, the printing head and the ink tank are formed as separate bodies so that the ink tank is allowed to be detachably attached to the printing head which is mounted in a printing apparatus.

FIG. 6 is a perspective view of an exemplary ink jet cartridge having the former type of configuration, i.e., a configuration in which a printing head and an ink tank are integrally formed. Referring to FIG. 6, an ink jet cartridge 1000 is primarily formed by an ink tank section 1200, a printing head section 1100, and an electrical wiring substrate 1300. Ink contained in the ink tank section 1200 is supplied to the printing head section 1100 and ejected from the printing head section 1100 according to a printing signal input from the electrical wiring substrate 1300.

Various types of ejection mechanisms usable in the printing head section 1100 have been proposed. For example, the printing head section 1100 may be provided with a plurality of printing elements each including a heating element, an ink path for guiding ink to the heating element, and an ejection opening serving as an exit of the ink path. In this case, the following mechanism works. The heating elements generate heat when a voltage pulse input through the electrical wiring substrate 1300 is applied to the same. Film boiling occurs in ink in contact with the heating elements, and the growing energy of the resultant bubbles ejects the ink through the ejection openings.

FIG. 7 is an exploded perspective view of the ink jet cartridge 1000, and FIG. 8 is a sectional view taken along the line VIIIA-VIIIA in FIG. 6. A tank case 1400 contains an absorbing body 1700 for absorbing and holding ink and has a mechanism for supplying the ink to a printing element substrate 1500 forming a part of the printing head section. A recess for accommodating the printing element substrate 1500 is formed on a bottom surface of the tank case 1400, and an ink flow path 1401 to serve as a path for supplying ink to the printing element substrate 1500 is provided in the middle of the recess. A filter 1600 is disposed at the bottom of the interior of the tank case 1400 and on the side of the tank case where the ink flow path is provided. The filter prevents foreign substances which have entered the tank case from flowing into the ink flow path 1401 or toward the printing element substrate 1500.

The tank case 1400 is closed by a lid member 1800 on the top side thereof. The absorbing body 1700 is pushed downward by ribs 1808 provided on the lid member 1800 to form spaces 1402 in the tank case 1400. The lid member 1800 has an atmospheric communicating port 1801 substantially in the middle thereof to provide communication between the spaces 1402 formed by mounting the lid member 1800 and the atmosphere.

FIG. 10 is a view of a top surface of the lid member 1800 taken when a sheet member 1900 is not applied thereto. The atmospheric communicating port 1801 located substantially in the middle of the lid member 1800 is connected to an atmospheric communicating channel 1803 formed as a maze-like groove on the surface of the lid member 1800. The sheet member 1900 is applied such that an end of the atmospheric communicating channel 1803 is left uncovered as shown in FIG. 9 to form an atmospheric communicating channel exit 1802.

As thus described, a mechanism for providing communication between the interior of the tank case 1400 and the atmosphere is provided to suppress fluctuations of an internal pressure which may be caused by gradual consumption of ink as a result of an ejecting operation. Thus, ink can be supplied to the printing element substrate 1500 with stability. However, the provision of the atmospheric communicating port 1801 as thus described may promote the evaporation of the ink in the ink tank. Therefore, it is required to design the channel for atmospheric communication so as to keep the evaporation of the ink in the tank case as small as possible while maintaining the communication between the interior of the tank case and the atmosphere. The amount of ink evaporating through the atmospheric communicating channel is proportionate to the sectional area of the atmospheric communicating channel 1803 and inversely proportionate to the length of the channel. Therefore, the above-mentioned requirement is met by a narrow and long atmospheric communicating channel having a complicated pattern as shown in FIG. 10.

The internal pressure of the tank case 1400 fluctuates as a result of not only printing operations but also changes in ambient conditions. When there is an abrupt change in the internal pressure or a great change in posture of the ink cartridge, ink may flow out through the atmospheric communicating port. It is therefore required to design the ink tank so as to prevent ink from flowing out from the atmospheric communicating port and to prevent the ink from leaking out to exterior of the tank in case ink flows out from the port.

Japanese Patent Laid-Open No. H05-318759(1993) discloses an ink jet cartridge having an ink reservoir member made of fiber provided in an ink tank to prevent ink from leaking out through an atmospheric communicating port by storing ink flowing from an absorbing body in the reservoir member. In the configuration disclosed in Japanese Patent Laid-Open No. H05-318759(1993), the ink reservoir member and the absorbing body are connected through an ink wick constituted by a fiber bundle. Even when there is a change in the posture of the cartridge, ink can be held by the ink wick without closing the atmospheric communicating port. It is therefore possible to prevent ink from leaking out even if there is a pressure change or a temporary shock.

Japanese Patent Laid-Open No. H10-278290(1998) discloses an ink jet cartridge having a configuration in which a recess for storing ink is formed in an atmospheric communicating channel to increase the amount of ink which can be stored in the atmospheric communicating channel.

In the case of the configuration disclosed in Japanese Patent Laid-Open No. H05-318759(1993), since the ink reservoir member and the absorbing body are connected through the ink wick constituted by a fiber bundle, ink tends to migrate from the absorbing body to the ink reservoir member because of the nature of the configuration. As a result, for example, when vibrations are continuously imparted to the cartridge in an inverted posture, the ink reservoir member can be saturated with ink, and leakage of ink can thereafter occur. Further, since the ink reservoir member has a complicated configuration, the ink tank itself may become problematically expensive.

In a configuration as disclosed in Japanese Patent Laid-Open No. H10-278290(1998) in which an ink reservoir is locally provided to store a great amount of ink, when the posture of the ink tank changes while ink is stored in the ink reservoir, ink flow-out can take place. The reason is that no force acts on the ink reservoir so as to allow the ink to be held against the change in posture. Further, communication between the interior of the tank case and the atmosphere is hindered when ink is stored in the atmospheric communicating channel. Thus, when the pressure in the tank case increases as a result of a temperature change or the like, the ink in the ink reservoir can leak out. The reason is that the atmospheric communicating channel is closed by the ink stored in the same.

SUMMARY OF THE INVENTION

The invention has been made taking the above-described problems in the related art into consideration. It is therefore an object of the invention to provide an inexpensive ink tank or an ink cartridge using the same in which ink scarcely leaks out of an atmospheric communicating channel due to a change in the internal pressure of the ink tank or an external shock regardless of the posture of the ink tank during transportation.

The first aspect of the present invention is an ink tank for containing ink, comprising: an atmospheric communicating port for providing communication between the interior of the ink tank with the atmosphere; an atmospheric communicating channel formed on an external part of the ink tank so as to extend in the form of a groove in connection with the atmospheric communicating port; and a sheet member applied to the exterior of the ink tank to so as to cover the atmospheric communicating port and the atmospheric communicating channel with an end of the atmospheric communicating channel uncovered, wherein the atmospheric communicating channel includes a first atmospheric communicating channel extending in connection with the atmospheric communicating port and a second atmospheric communicating channel branching off from the first atmospheric communicating channel and joining the first atmospheric communicating channel again, the second atmospheric communicating channel having a capillary force greater than that of the first atmospheric communicating channel.

The second aspect of the present invention is an ink jet cartridge, comprising: an ink tank according to any of claims 1 to 5; and a printing head for ejecting ink on to a printing medium, the ink tank and printing head being formed integrally with each other.

Further features of the present invention will become apparent from the following description of exemplary embodiments (with reference to the attached drawings).

DESCRIPTION OF THE EMBODIMENTS

Embodiment 1

Figure 1:
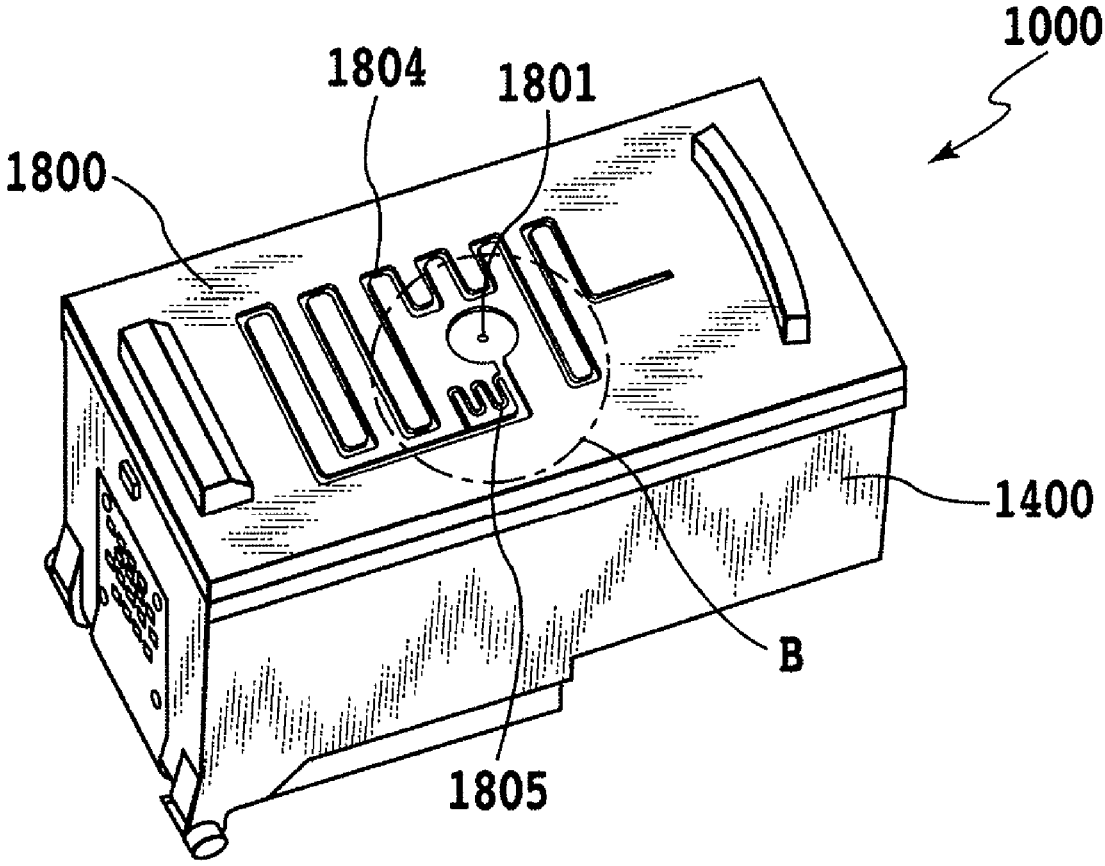
FIG. 1 is an illustration of an ink jet cartridge according to Embodiment 1 of the invention, showing the appearance of a top surface of a lid member with no sheet member bonded thereto.
Figure 2:
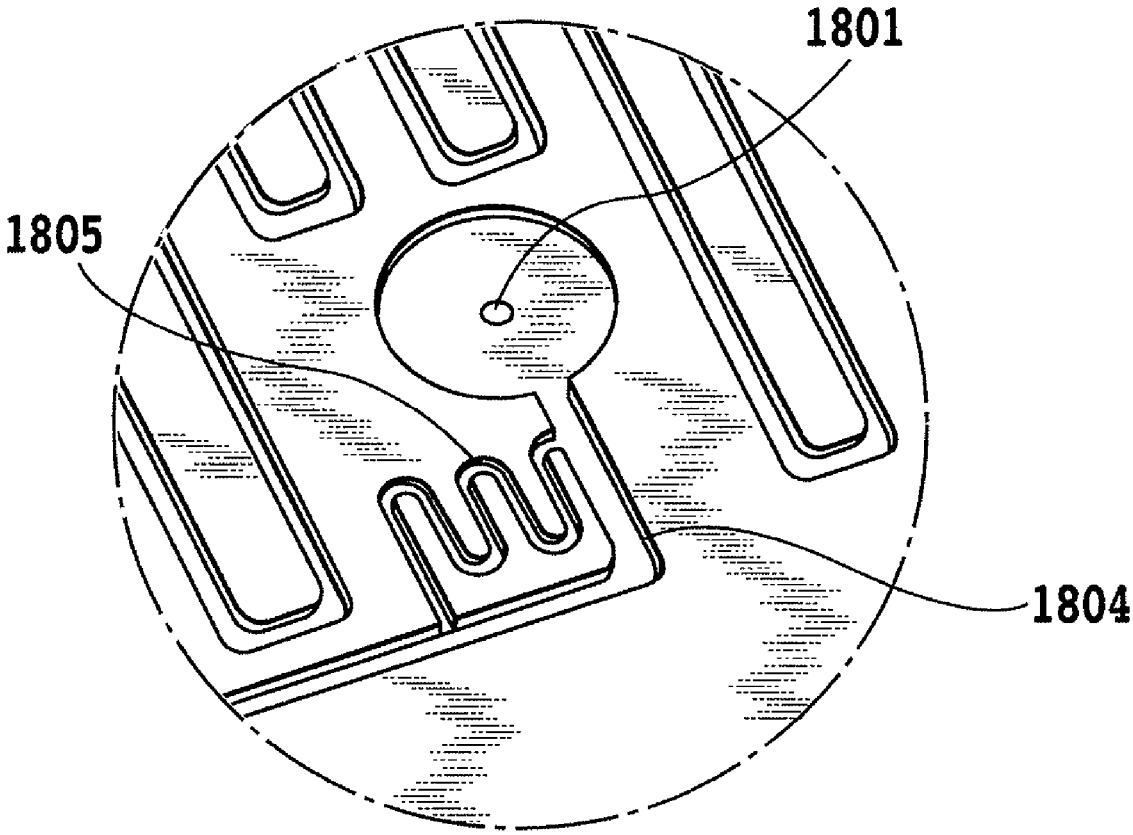
FIG. 2 is an enlarged view of the neighborhood (region B) of an atmospheric communicating channel shown in FIG. 1, for explaining a configuration of the atmospheric communicating channel.

FIG. 1 is an illustration of an ink jet cartridge 1000 according to Embodiment 1 of the invention, showing the appearance of a top surface of a lid member 1800 before bonding a sheet member 1900 to the same. FIG. 2 is an enlarged view of the neighborhood (region B) of an atmospheric communicating port 1801 shown in FIG. 1, for explaining a configuration of an atmospheric communicating channel.

The atmospheric communicating port 1801 which opens on the top surface of the lid member is connected to a first atmospheric communicating channel 1804 extending in the form of a groove on the top surface of the lid member. A second atmospheric communicating channel 1805 having a capillary force greater than that of the first atmospheric communicating channel 1804 branches off from the first atmospheric communicating channel 1804 and joins the channel 1804 again.

Condensation attributable to a pressure change, external shock, or temperature change may occur in a tank case 1400 to form droplets on an inner wall of the case. The droplets formed around the atmospheric communicating port 1801 may be pushed into the atmospheric communicating channel 1804 through the atmospheric communicating port 1801 due to a pressure change that occurs later.

Even in such a case, in the configuration of the present embodiment, the ink which has entered the first atmospheric communicating channel 1804 is absorbed into the second atmospheric communicating channel 1805 having a greater capillary force. Further, at the exit into the first atmospheric communicating channel 1804, a force acts on the ink so as to hold it in the second atmospheric communicating channel 1805 having a grater capillary force. That is, the configuration allows the ink flowing out from the atmospheric communicating port 1801 to be guided into the second atmospheric communicating channel 1805 and to be held therein with priority over the first channel 1804. Therefore, even if some amount of ink flows out from the atmospheric communicating port 1801, the first atmospheric communicating channel 1804 can keep the function of providing communication with the atmosphere.

That is, in the configuration of the present embodiment, even when the posture of the ink tank changes with the ink stored in the second atmospheric communicating channel 1805, the capillary force generated in the second atmospheric communicating channel acts to hold the ink against the change in posture. Therefore, even when the posture of the ink tank changes, there is little possibility that the ink will flow further to exit the tank from an end of the atmospheric communicating channel where no sheet member is applied. The pressure in the tank case is kept in equilibrium with the atmospheric pressure even when ink is stored in the second atmospheric communicating channel 1805 because the first atmospheric communicating channel 1804 is not closed. Thus, there is little possibility that the ink in the second atmospheric communicating channel 1805 will be pushed out as a result of a change in the ambient temperature.

As described, according to the present embodiment, it is possible to provide an inexpensive ink jet cartridge in which ink scarcely leaks out of an atmospheric communicating channel as a result of a change in an internal pressure, an external shock, or a temperature change regardless of the posture of the cartridge during transportation.

The width, length, and shape of the second atmospheric communicating channel 1805 of the present embodiment are preferably designed according to the ink-containing capacity or the internal volume of the ink tank such that an expected amount of overflowing ink can be sufficiently accommodated in the channel.

Embodiment 2

Figure 3:
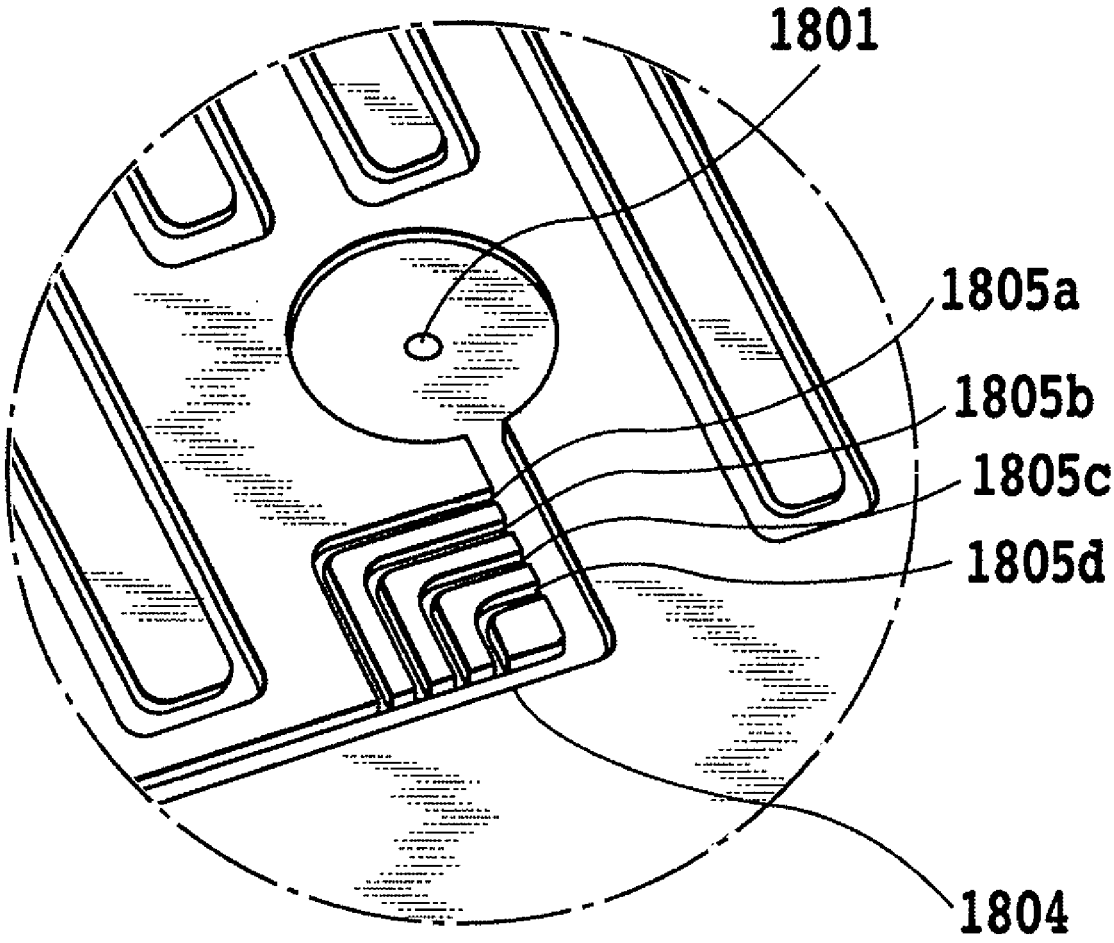
FIG. 3 is an illustration of a part of an ink jet cartridge according to Embodiment 2, for explaining a configuration of atmospheric communicating channels in the neighborhood of an atmospheric communicating port.

FIG. 3 is an illustration for explaining a part of an ink jet cartridge according to Embodiment 2 of the present invention.

As illustrated in FIG. 3, in the present embodiment, there is a plurality of second atmospheric communicating channels 1805*a*, 1805*b*, 1805*c* and 1805*d*. Each of the second atmospheric communicating channel branches off from a first atmospheric communicating channel 1804, and joins the first atmospheric communicating channel 1804 again. That is, a plurality of second atmospheric communicating channels is connected to the first atmospheric communicating channel 1804. Since there is a plurality of entrances into the second atmospheric communicating channels, ink can be absorbed into the second atmospheric communicating channels and held therein with reliability higher than that in the first embodiment even when the ink flows in the first atmospheric communicating channel 1804 at a high flow rate.

If a second atmospheric communicating channel 1805 whose entrance is located upstream of a bent section of a first atmospheric communicating channel 1804 and whose exit is located downstream of that, is provided, a way from the entrance to the exit can be longer than that of a construction in which both of the entrance and exit are located upstream of the bent section of the first atmospheric communicating channel. When ink flows the first atmospheric communicating channels passing the entrance of the second atmospheric communicating channel 1805, in the case of former construction, the ink soon reaches the exit of the second atmospheric communicating channel and clog up it, then the ink in the first path can not be easily absorbed into the second atmospheric communicating channel 1805. On the other hand, in the latter construction (the construction of FIG. 3), since a way from the entrance to the exit is long, the timing of clogging up the exit is later than the case of the former construction and the ink can be reliably held in the second atmospheric communicating channels. At the bent part, a plurality of second atmospheric communicating channels can be formed using a relatively simple channel configuration.

Embodiment 3

Figure 4:
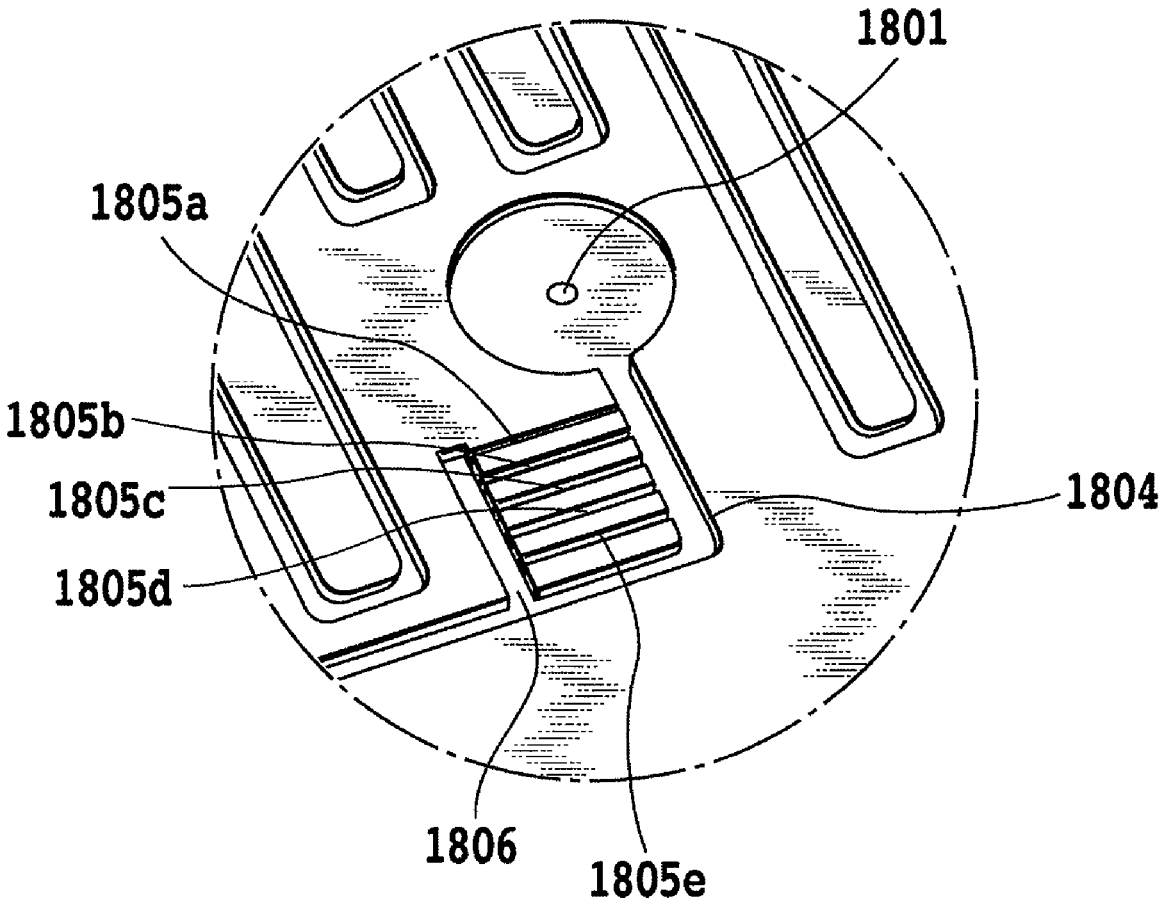
FIG. 4 is an illustration of a part of an ink jet cartridge according to Embodiment 3, for explaining a configuration of atmospheric communicating channels in the neighborhood of an atmospheric communicating port.

FIG. 4 is an illustration for explaining a configuration of a part of an ink jet cartridge according to Embodiment 3 of the invention.

As illustrated in FIG. 4, in the present embodiment, a plurality of second atmospheric communicating channels 1805 (1805*a* to 1805*e*) join the first atmospheric communicating channel 1804 through a third atmospheric communicating channel 1806 which has a smaller capillary force. The third atmospheric communicating channel 1806 is designed to have a capillary force smaller than that of the second atmospheric communicating channels 1805 and greater than that of the first atmospheric communicating channel 1804.

Therefore, providing a plurality of second atmospheric communicating channels, ink can be reliably absorbed into the second atmospheric communicating channels and held therein even when ink flows in the first atmospheric communicating channel 1804 at a high flow rate.

Embodiment 4

Figure 5:
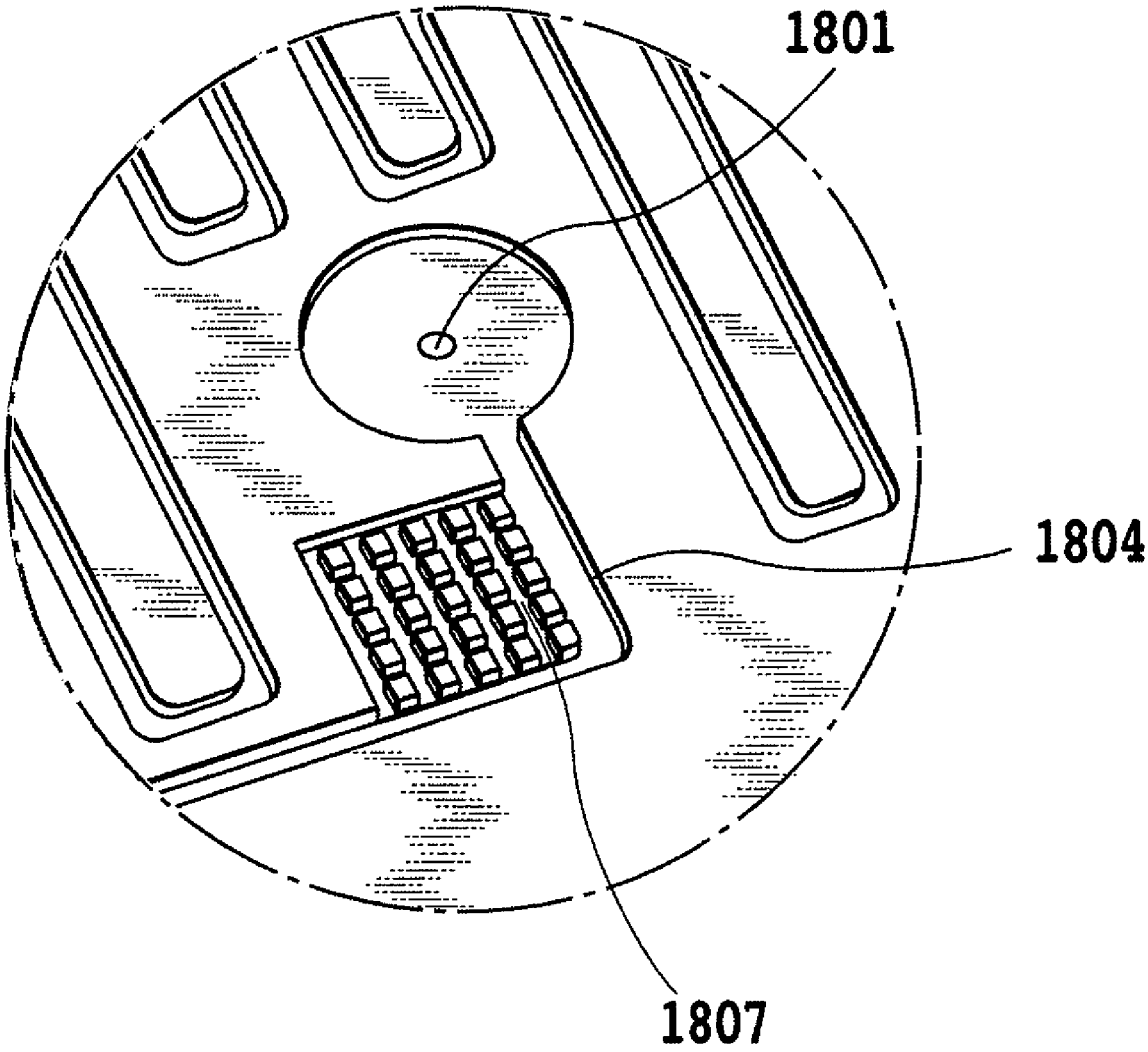
FIG. 5 is an illustration of a part of an ink jet cartridge according to Embodiment 4, for explaining a configuration of atmospheric communicating channels in the neighborhood of an atmospheric communicating port.
Figure 6:
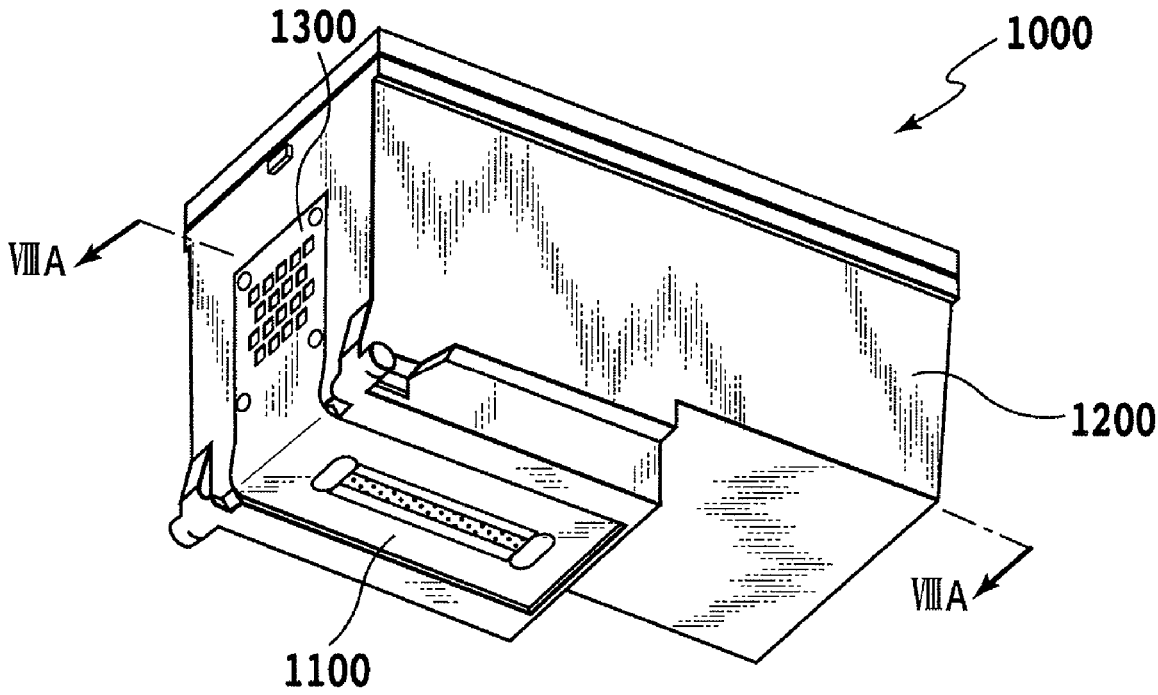
FIG. 6 is a perspective view of an example of an ink jet cartridge having a configuration in which a printing head and an ink tank are formed integrally with each other.
Figure 7:
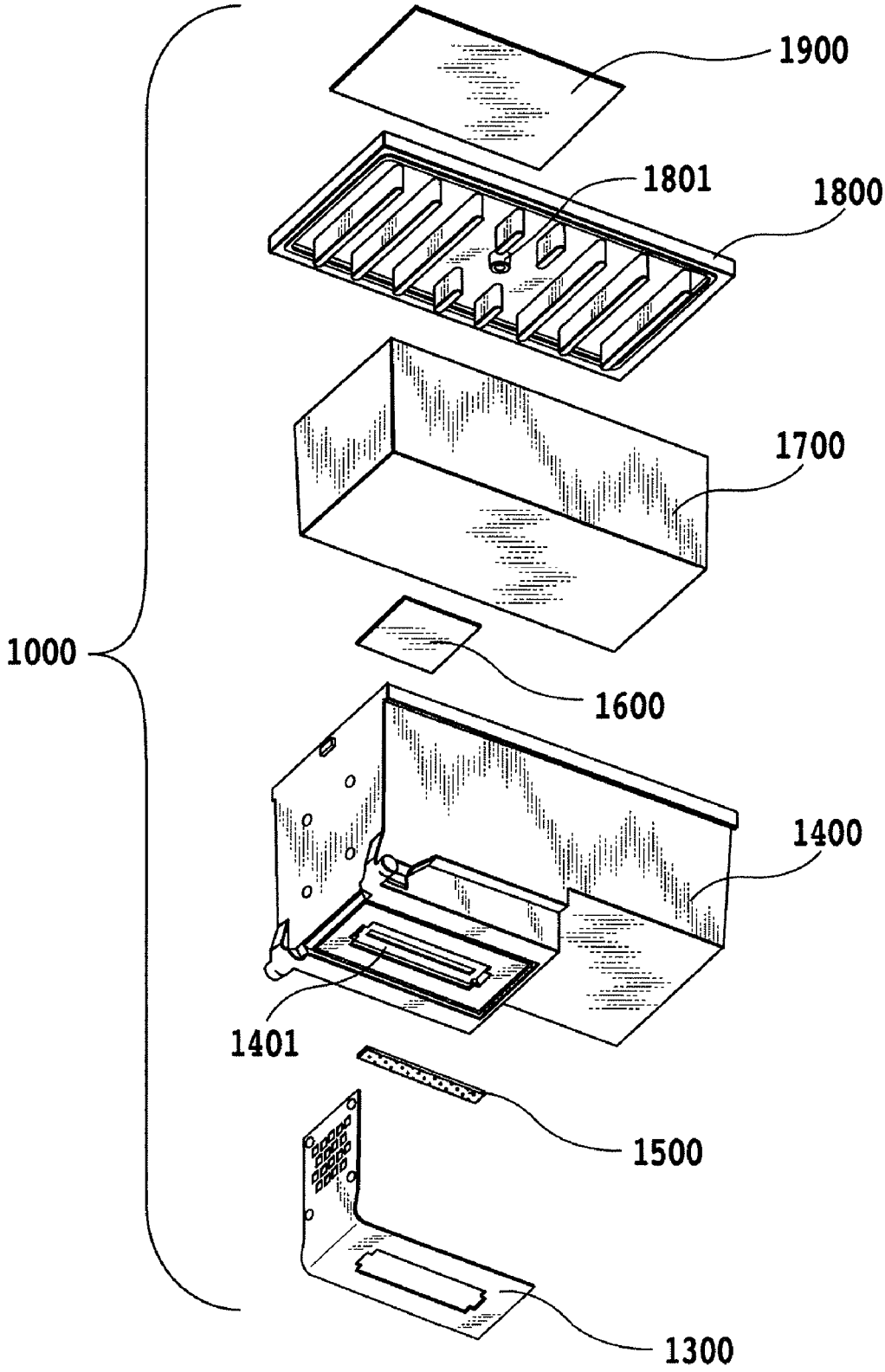
FIG. 7 is an exploded perspective view of an ink jet cartridge which can be applied to the invention.
Figure 8:
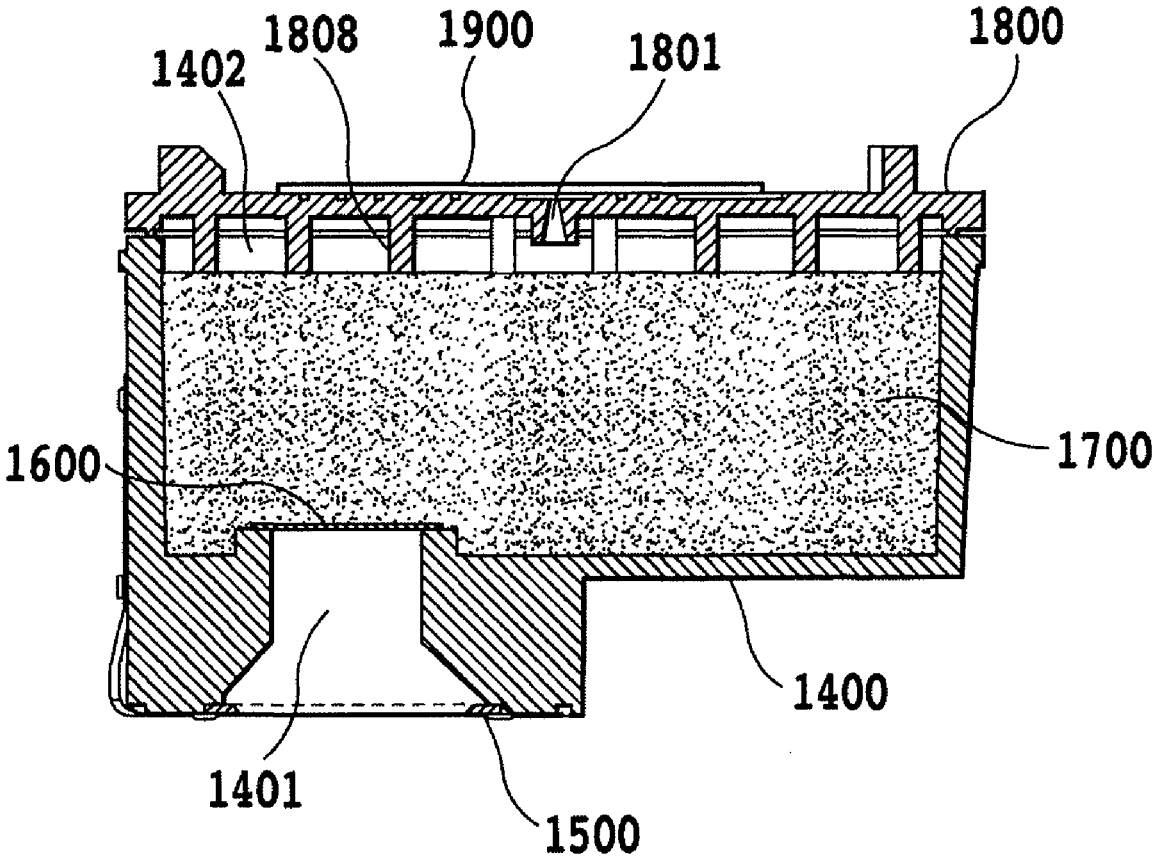
FIG. 8 is a sectional view taken along the line VIIIA-VIIIA in FIG. 6.
Figure 9:
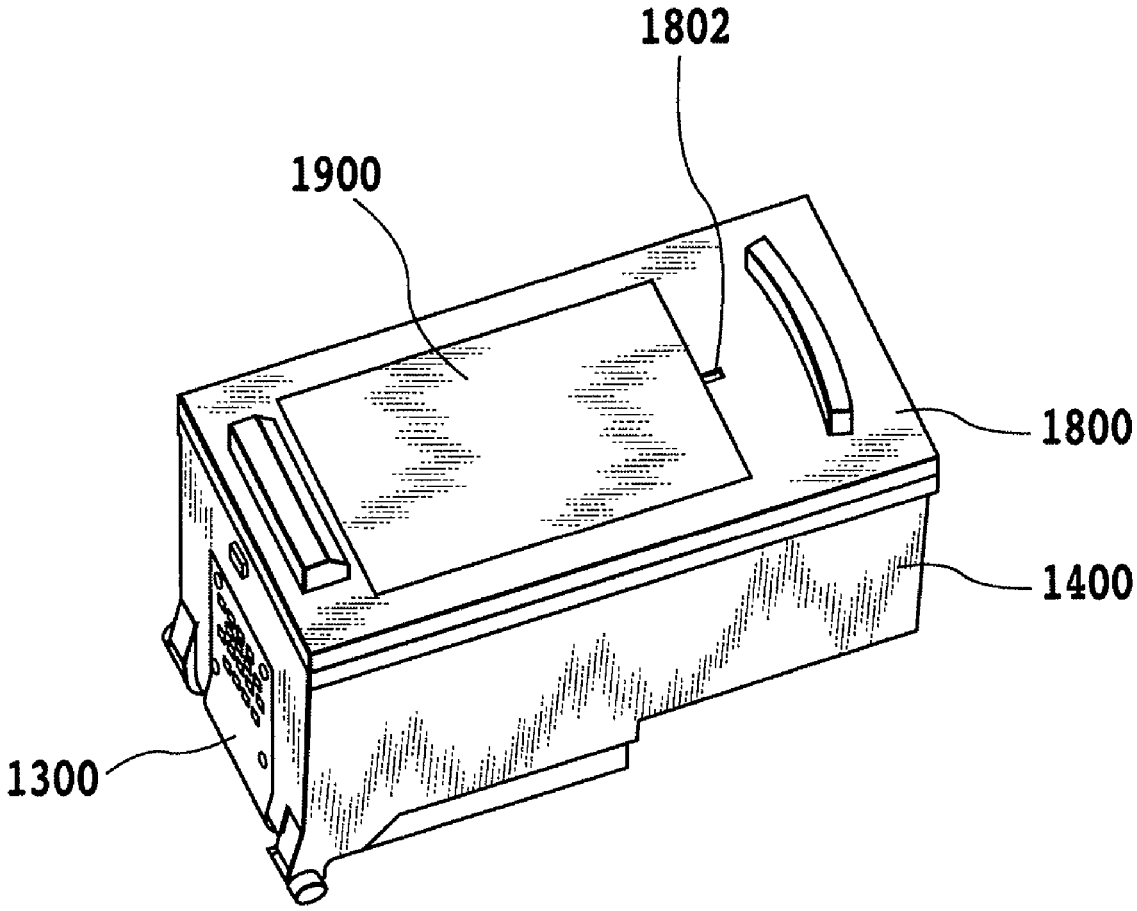
FIG. 9 is an illustration of a top surface of a lid member with a sheet member applied thereto.
Figure 10:
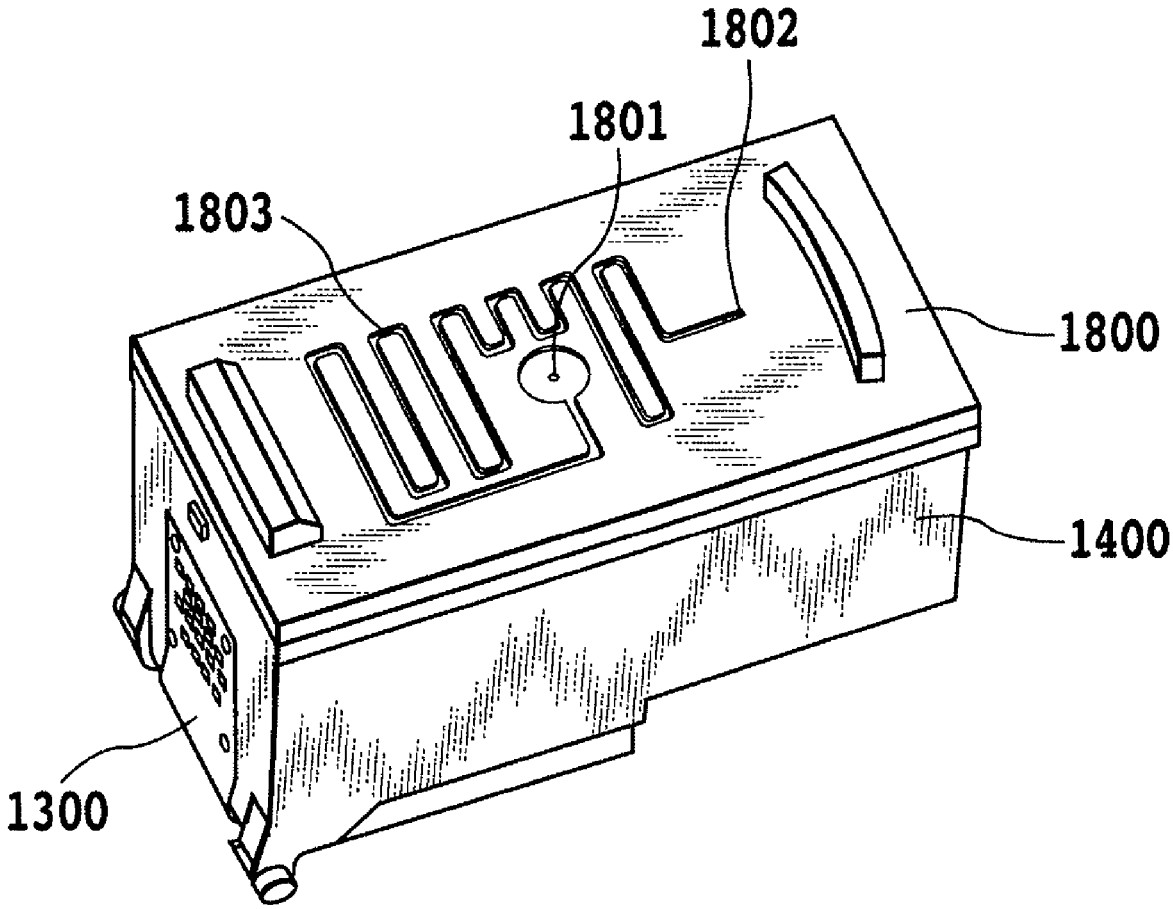
FIG. 10 is an illustration of a top surface of the lid member with a sheet member not applied thereto.

FIG. 5 is an illustration of a part of an ink jet cartridge according to Embodiment 4 of the invention, for explaining a configuration of atmospheric communicating channels in the neighborhood of an atmospheric communicating port.

In the present embodiment, second atmospheric communicating channels branching off from a first atmospheric communicating channel 1804 and having a capillary force greater than that of the first atmospheric communicating channel are formed to extend across each other to provide a lattice-shaped communicating channel network 1807 as illustrated. Although an atmospheric communicating channel network 1807 in a uniform lattice pattern is illustrated as an example, the invention is not limited to the illustrated configuration of the communicating channels. Any channel configuration may be employed, as long as the channel configuration is complicated enough to increase the area of the second atmospheric communicating channels and consequently the ink holding capacity of the channels.

As described above, according to the invention, even when the posture of an ink tank changes with ink stored in an atmospheric communicating channel, a capillary force generated in the second atmospheric communicating channel acts to hold the ink against the change in posture. Thus, the ink is prevented from leaking out of the ink tank. Since the first atmospheric communicating channel is not closed even when ink is stored in the second atmospheric communicating channel, the pressure in the tank case is kept in equilibrium with the atmospheric pressure. Therefore, the ink in the second atmospheric communicating channel will not be pushed out even when there is a change in the ambient temperature. It is therefore possible to provide an inexpensive ink jet cartridge in which ink scarcely leaks out of an atmospheric communicating channel due to a change in an internal pressure, an external shock, or a temperature change regardless of the posture of the cartridge during transportation.

The above-described embodiments employ a configuration in which second atmospheric communicating channels are provided at a bent part of a first atmospheric communicating channel in order to hold ink in the channels with higher reliability. However, the invention is not limited to such a configuration. A second atmospheric communicating channel may alternatively be formed such that its entrance and exit are disposed at the same straight part of a first atmospheric communicating channel. As long as the second atmospheric communicating channel has a capillary force greater than that of the first atmospheric communicating channel, the alternative configuration allows the advantage of the invention to be achieved, and it is therefore included in the scope of the invention.

The above embodiments of the invention have been described by addressing an exemplary ink jet cartridge having a configuration in which an in ink tank is formed integrally with a printing head for ejecting ink on to a printing medium. However, the invention is not limited to such a configuration. The advantage of the invention shown in the description of the embodiments can be sufficiently achieved in a configuration in which an ink tank is independently formed such that it can be attached and removed to and from a printing head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-034660, filed Feb. 15, 2008, which is hereby incorporated by reference herein in its entirety.

What is claimed is:

1. An ink tank for containing ink, comprising:

an atmospheric communicating port for providing communication between the interior of the ink tank with the atmosphere;

an atmospheric communicating channel formed on an external part of the ink tank so as to extend in the form of a groove in connection with said atmospheric communicating port; and a sheet member applied to the exterior of the ink tank to so as to cover said atmospheric communicating port and said atmospheric communicating channel with an end of said atmospheric communicating channel uncovered, wherein said atmospheric communicating channel includes a first atmospheric communicating channel extending in connection with said atmospheric communicating port and a second atmospheric communicating channel branching off from said first atmospheric communicating channel and joining said first atmospheric communicating channel again, said second atmospheric communicating channel having a capillary force greater than that of said first atmospheric communicating channel.

2. An ink tank according to claim 1, wherein said atmospheric communicating channel includes a plurality of said second atmospheric communicating channels.

3. An ink tank according to claim 1, wherein said atmospheric communicating channel further includes a third atmospheric communicating channel which connects a plurality of said second atmospheric communicating channels and said first atmospheric communicating channel and which has a capillary force greater than that of said first atmospheric communicating channel and smaller than that of said second atmospheric communicating channels.

4. An ink tank according to claim 1, wherein said atmospheric communicating channel includes a plurality of said second atmospheric communicating channels extending to intersect each other.

5. An ink tank according to claim 1, wherein said second atmospheric communicating channel is provided at a bent part of said first atmospheric communicating channel.

6. An ink jet cartridge, comprising:

an ink tank according to any of claims 1 to 5; and a printing head for ejecting ink on to a printing medium, said ink tank and printing head being formed integrally with each other.

* * * * *